United States Patent [19]

Godeau et al.

[11] 4,109,479

[45] Aug. 29, 1978

[54] METHOD AND APPARATUS FOR TENSIONING ANCHOR LINES

[75] Inventors: Alain Godeau, Pau; Jean-Yves Heas, Bizanos, both of France

[73] Assignee: Societe Nationale Elf Aquitaine (Production), Paris, France

[21] Appl. No.: 842,797

[22] Filed: Oct. 17, 1977

[30] Foreign Application Priority Data

Oct. 19, 1976 [FR] France ..... 76 31394

[51] Int. Cl.[2] ..... E02B 17/00; B63B 35/44; B63B 21/50

[52] U.S. Cl. ..... 61/94; 61/95; 9/8 P; 114/256; 114/264; 114/293

[58] Field of Search ..... 61/94, 95, 87, 90, 98, 61/88; 114/293, 265, 264, 267, 256; 9/8 P

[56] References Cited

U.S. PATENT DOCUMENTS 2,986,889 6/1961 Ludwig ..... 61/94

3,771,481 11/1973 Goren et al. ..... 61/94

4,020,779 5/1977 Kitt ..... 114/293

*Primary Examiner*—Jacob Shapiro

*Attorney, Agent, or Firm*—Brisebois & Kruger

[57] ABSTRACT

A method and apparatus for tensioning anchor lines connecting a marine structure to the ocean floor. The apparatus includes a platform movable in relation to the structure, and suspended from the structure by a pulley system with a cable having a free end connected to a vessel. The cable is pulled either by moving the vessel along a rectilinear path passing essentially through the center of the structure, or by a pulling system on the vessel. Diametrically opposed pairs of anchor lines are hooked under the said movable platform, each line passing through the groove of a pulley and then through a stopper device fixed to the marine structure. The method and apparatus are particularly adapted for anchoring an emerging structure built on a jointed column.

10 Claims, 7 Drawing Figures

1
1a
1b
1c
1d
2
3
4
5
6
7
8
9
18
19
21
22
25
25a
25b
26
26'
27
27'
28
29
30
31
32
34
36
37
38
39
40
A
a
a'
b
b'
c
c'
d
d'
e
e'
f
f'

METHOD AND APPARATUS FOR TENSIONING ANCHOR LINES

This application is related to application No. 76.31394, filed Oct. 19, 1976, in France, and the disclosure of that French application is incorporated herein by reference.

The present invention relates to an apparatus for tensioning anchor lines connecting a marine structure to the ocean floor.

Floating marine structures such as vessels, various types of pontoons, or even platforms, semisubmersible or not, can be held vertically above a determined position by the use of elaborate navigation means for this purpose and especially by means of dynamic positioning. They can also be held in a determined position by anchor lines connecting the structures to several anchoring points spaced on the ocean floor.

Emerging marine structures standing or supported on a jointed column are the object of lateral displacements, which become more significant as the water depth increases. To limit these displacements, one connects the structures to the ocean floor with anchoring lines, which are then tensioned.

In the different mentioned marine structures, the tensioning of the anchor lines is usually done with the aid of winches or of jacks driven by electric or heat motors and located on a floor fixed to the structure.

The difficulties of placement, unmounting, and maintenance of the winches, jacks, and driving motors necessitate a multiplication of auxiliary installations which operate at determined times of the history of the structure and in the intervals between these times of usage constitute a significant dead weight and occupy precious space.

The process according to the invention alleviates these difficulties by locating the pulling equipment externally of and separate from the structure and only leaving less costly equipment, requiring only small maintenance and which is less cumbersome, on the fixed floor of the structure.

An apparatus according to the invention for tensioning anchor lines joining a marine structure to the ocean floor is characterized in that the anchor lines, in pairs of diametrically opposed lines, are hooked under a platform moveable in translation in relation to the marine structure between an upper position and a lower position, each line passing in the groove of a pulley whose axis, by means of a pulley head, is kept at a determined distance from a floor fixed in relation to the structure and located below the lower position of the movable platform. The anchor lines pass next into stoppers (which are chain stoppers when the anchor lines are chains) likewise fixed on the same floor, and then extend to anchoring means placed on the ocean floor. The movable platform is suspended from the marine structure by a pulley system comprising a fixed block hooked to the structure above the upper position of the movable platform, a movable block supporting the movable platform by a hook, and a cable extending around the pulleys of the blocks and whose one extremity is fixed on one of the blocks, and whose other extremity or free end is connected to a means for exerting a tractive force.

In the various embodiments, the upper and lower positions of the movable platform are limited respectively by stops fixed near the bottom and stops fixed near the top of rectilinear parallel guides, the guides being secured to the structure and each of the guides extending into a groove formed on the periphery of the movable platform in such a way that the platform slides longitudinally along these guides.

In certain embodiments, the means for exerting a pulling force is constituted by a winch fixed on a vessel held at an essentially constant distance from the marine structure during each operation.

In other embodiments, the means for exerting the pulling force is constituted by a vessel such as a ship moving along a rectilinear path passing essentially through the center or median of the structure.

In a preferred embodiment, the chain stoppers are equal in number to the number of anchor lines, are fixed at fastening points disposed along the periphery of the fixed floor, the two pulleys whose axes are kept at a maximum distance apart, determined by the fixed floor, are made movable around the floor by engagement of a groove in the lower part of their pulley head with a circular rail secured to the fixed floor, and essentially centered at the gemetric center of the fastening points of the chain stoppers.

The invention will be better understood in the description given, as a non-limiting example, of the apparatus illustrated, with the aid of the drawings.

DETAILED DESCRIPTION OF PREFERRED EMBODIMENT

Figure 1:
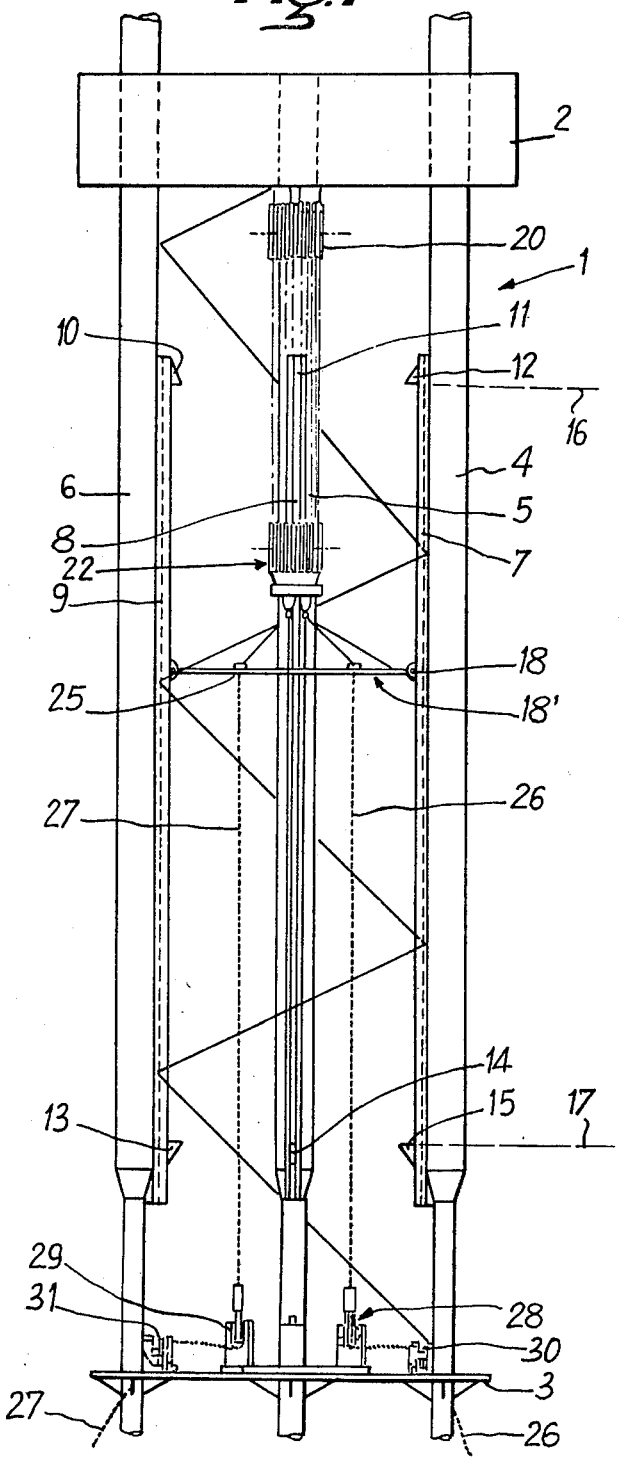
FIG. 1 is a partial front view in elevation of a marine structure, including the anchor line tensioning apparatus of this invention.

FIG. 1 shows an emerging or above water portion of a structure 1 which can be supported either by an articulate column (FIG. 3) such as column 1*a* supported on the ocean floor 1*b* by a ball and socket joint 1*c*, or by a submerged body, not shown, forming semi-submersible assembly with the structure 1.

Structure 1 comprises an upper part or upper bridge 2, and a lower fixed floor 3 connected by three upright tubular frame members 4, 5, 6, extending downward and fixed, by means not shown, on an articulated column or on a submerged body.

Figure 2:
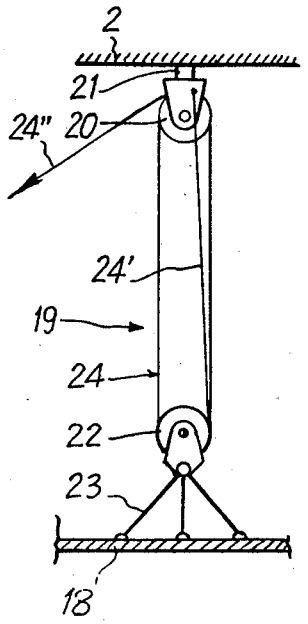
FIG. 2 is a view in elevation showing the pulley system schematically.

The three tubular members 4, 5, 6, are parallel and support three guides 7, 8, 9, also parallel, formed from flat iron or T-iron. The three guides 7, 8, 9, are each provided with upper stops 10, 11, 12, facing downwardly and lower stops 13, 14, 15 facing upwardly. The stops limit the upper extreme position 16 and the lower extreme position 17 of a movable truck or platform 18, suspended from the upper part 2 of the marine structure by a pulley system 19 of a known type and the details of which are shown at FIG. 2.

The pulley system 19 (FIGS. 1 and 2) comprises a fixed pulley block 20 suspended by a universal joint 21, and generally by a hook, from the upper part 2, a movable pulley block 22 from which platform 18 is suspended by a plurality of cables or chains, such as 23, of equal length and constituting the generatrices of a cone of revolution, and a cable 24 of the pulley system having one extremity 24' fixed to the block 21 and the other extremity 24'' fixed to a vessel (not shown) capable of moving along a rectilinear path passing essentially through the median position of the structure.

FIG. 1 shows the movable platform 18 provided with means connecting with the three guides 7, 8, 9. The connecting means, of a well known type can be grooves made on the periphery of the movable platform, grooves into which guides 7, 8, 9 extend, permitting longitudinal displacements of the platform, parallel to guides 7, 8, 9 between the lower position 17 and the upper position 16.

The movable platform 18 has on its lower face 18' a plurality of hooking means 25, such as hooks, to fix to the platform 18, anchor lines 26 and 27, such as chains, but called anchor lines.

The anchor lines 26, 27 are supported by the movable platform and tensioned by the action of the latter. The lines 26, 27 are used in pairs of diametrically opposed lines, each passing in the groove of a respective pulley 28 and 29, whose axes, by means of their pulley heads are held at a fixed distance from the floor 3 which is fixed in relation to the structure and is situated below the lower position 17 of the movable platform. The anchor lines pass from the pulleys into chain stoppers 30 and 31 of a known type fixed on the fixed floor 3, and the ends of the anchor lines are connected to anchors 26', 27' at the ocean floor (FIG. 3).

Figures 3, 4, 5, 6, 7:
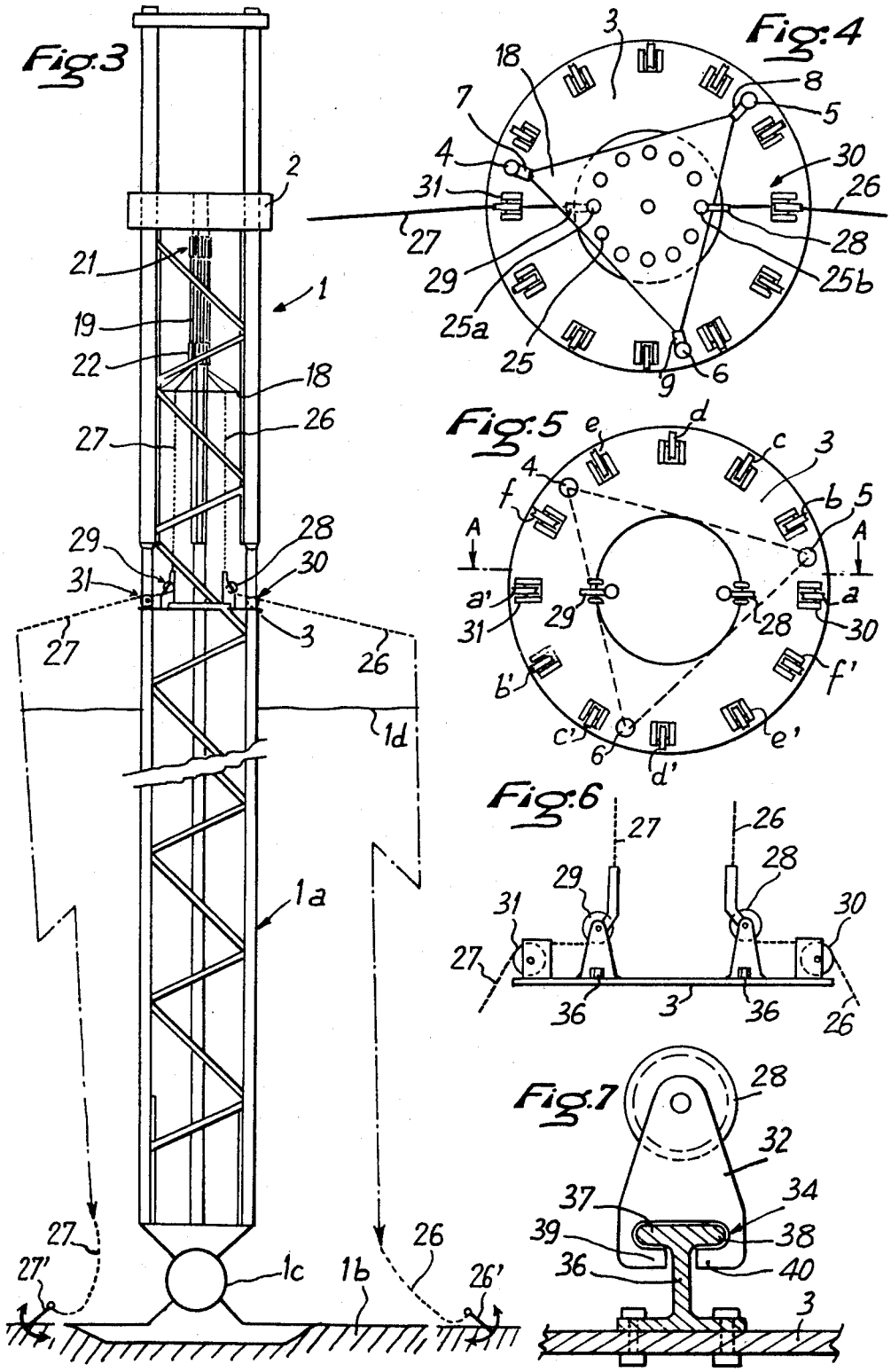
FIG. 3 is a view in elevation showing a marine structure with the tensioning apparatus of this invention, with the anchor lines partly broken away.
FIG. 4 is a plan view in section, with portions removed, of the movable platform and the fixed floor.
FIG. 5 is a view in plan of the fixed floor, with the movable platform shown in dotted lines.
FIG. 6 is a partial view in section taken along line A—A of FIG. 5.
FIG. 7 is an enlarged view in partial section of the details of the connection between the pulley and the track on the fixed floor.

FIG. 3 shows an articulated column provided with an apparatus for putting anchor lines under tension, such as that described with reference to FIG. 1. The articulated column 1*a* rests on the ocean floor 1*b*, on a ball and socket joint 1*c*. The surface of the water is represented by 1*d*. Shown at FIG. 3 are the characteristic elements of the devices for tensioning anchor lines such as have been described for FIG. 1, with the same reference numerals.

In FIG. 3 there is the upper bridge 2 and the lower fixed floor 3 between which the movable platform 18 can move. The movable platform 18 is suspended from the upper bridge 2 by a pulley system 19 comprising a fixed block 20 and a movable block 22.

To the movable platform 18 are fixed the anchor lines 26 and 27, such as chains, the anchor lines 26 and 27 pass respectively into the grooves of the pulleys 28 and 29, then into chain stoppers 30 and 31 and then end at the ocean floor 1*b* with anchoring means, 26 and 27 respectively.

FIG. 4 is a view in plan of the movable platform 18 and the fixed floor 3. One can see on the mobile platform 18 the locations of the hooking means such as 25, 25*a* and 25*b* for fixing the anchor lines 26 and 27 to the bottom 18' of the movable platform 18.

One sees on the fixed floor 3, the chain stoppers 30 and 31, diametrically opposed, used for stopping anchor lines 26 and 27. The stoppers 30, 31 are one pair of stoppers among the six pairs of stoppers diametrically opposed and regularly distributed about the periphery of fixed floor 3.

FIGS. 4 and 5 show the two grooved pulleys 28 and 29 in diametrically opposed positions and aligned with chain stoppers 30 and 31.

FIG. 5 is a view from above fixed floor 3 showing the position of the two grooved pulleys 28 and 29 mounted for movement into alignment with the different pairs of stopper chains. Diametrically opposed chain stoppers are designated by *a a'*, *b b'*, etc.

The pair of stoppers *a, a'* (30, 31) are in the same plane of symmetry (vertical plane) passing through the axis of the emerging structure 1 as the pair of pulleys 28, 29, when the pulleys are positioned as shown in FIG. 5.

FIG. 6 shows a cross-section of the fixed floor 3. Shown are the two anchor lines 26 and 27 passing respectively through the grooved pulleys 30 and 31.

FIG. 7 shows one of the two grooved pulleys, here pulley 28. Axis 28' of pulley 28 is kept at a maximal fixed distance from fixed floor 3 by a pulley head 32, in the base of which is a groove 34 whose contour, with a clearance of several millimeters, is similar to the contour of a track 36.

Track 36 has a symmetrical section of T shape, with two lateral head portions 37 and 38, constituting opposite sides of stops which enter and contact the re-entering parts 39 and 40 of the groove 34 formed in the head 32 of pulley 28. The pulley head 33 of pulley 29 is made the same way.

Track 36 is circular, and has its center at the geometric center of the fastening points of the chain stoppers, here at the center of the circle constituting the fixed floor 3. The two pulleys 28 and 29 are associated successively with each of the opposite pairs of chain stoppers, and thus with each of the opposite pairs of anchor lines.

The operation of the apparatus according to the invention comprises arranging an even number of anchor lines, regularly distributed around the structure, and passing each through a generally aligned chain stopper on the periphery of the fixed floor 3. This can be done by supplying lengths of chains or lines sufficient to ultimately fix them, by hooking means 25, to the movable platform 18 when the platform is in the lower position 17. The chain stoppers hold the lines.

A pair of diametrically opposed anchor lines are selected and passed respectively through the grooved pulleys 28 and 29; these pulleys constitute direction modifiers and lead the anchor line segments between pulleys 28 and 29 and the respective hooking means to the movable platform 18, essentially parallel to the guides 7–9 of the movable platform.

With the movable platform suspended, at its lower position 17 (FIG. 1), from the upper part 2 of structure 1 by pulley system 19, a tractive force is applied the free end 24'' of the cable of the pulley system, from a vessel located in the vicinity of the structure.

This tractive or pulling force can be applied with a winch placed on the vessel, with the vessel staying essentially stationary. One can also simply fasten the free extremity of the cable to a fastening point on the vessel, and move the vessel in a rectilinear path passing essentially through the median position or center of the structure. In this case, the service vessel, going away from the structure 1, exerts on the movable platform a force equal to the tension of the cable, at the fastening point of the service vessel, multiplied by the coefficient of mechanical advantage of the pulley system.

Either of these pulling techniques permit, without endangering the stability of the structure, displacing the movable platform 18 from the lower position 17 to the upper position 16.

After sufficient pull is exerted on cable 24 to lift the platform 18 to its upper position 16, the tension on the cable 24 is released to permit platform 18 to return to its lower position 17. During this downward movement of platform 18, the two anchor lines remain stopped by the chain stoppers through which they extend so that none of the tension in the anchor lines between the stoppers and the anchors is lost. If the tension in the anchor lines between the chain stoppers and the anchors is insufficient, slack is removed from the lines between the respective pulleys 28, 29 and the hooking locations 25 at the bottom of platform 18. Then cable 24 is again pulled from the vessel to lift platform 18 and further tension the two anchor lines. At the end of each platform raising operation, as well as after the last pulling operation which provides the desired tension, the two anchor lines each remain blocked by the chain stoppers.

The same operation is then repeated for each of the other pairs of anchor lines, the pulleys 28 and 29 being shifted to new positions on the track to be in alignment with the opposed pairs of chain stoppers for the anchor lines then being tensioned.

Where the anchor lines take the form of ropes or cables rather than chains, it is of course evident that suitable stoppers or grippers can be used rather then the specified chain stoppers. In addition, in some instances two or more pairs of anchor lines can be tensioned simultaneously.

It is of course evident that the method and apparatus described can be used to tension anchor lines of wholly submerged structures or bodies, as well as floating and partially submerged bodies.

Numerous variations can of course be made in the method and apparatus disclosed without departing from the scope of the invention.

What is claimed is:

1. Apparatus for tensioning anchor lines connecting a marine structure to the ocean floor characterized in that there is a movable assembly, connecting means for releasably connecting at least one pair of anchor lines to said movable assembly, means mounting said movable assembly for movement vertically on said structure to an upper position and a lower position, a floor fixed to said structure below the lower position of said assembly, a plurality of anchor line stopper devices fixed on said floor in generally opposed relation to each other, a plurality of pulleys between the chain stoppers and the assembly, said movable assembly being suspended from the structure by a pulley system including a fixed block connected to the structure above the upper position of the movable assembly and a movable block connected to the movable assembly, and a cable connecting the pulleys and having one end fixed with respect to one of the blocks, and its other end connected to means for exerting a pulling force, said tensioning apparatus being adapted to tension opposed anchor lines extending from anchors on the ocean floor through the chain stoppers, and then through the pulleys to the connecting means on the movable assembly.

2. Apparatus according to claim 1 wherein said means mounting said assembly for movement comprises fixed vertically extending parallel guides secured to the structure, said movable assembly comprises a base portion having grooves in its periphery, said fixed parallel guides extend into said grooves to guide the movable assembly longitudinally along the guides, and upper and lower stop means on said guides to limit the upper and lower positions of said movable assembly.

3. Apparatus according to claim 1 wherein said means for exerting a pulling force comprises, a winch fixed on a vessel maintained at an essentially constant distance from the marine structure during an anchor line tensioning operation.

4. Apparatus according to claim 1 wherein said means for exerting a pulling force comprises a vessel separate from said structure and moving along a rectilinear path passing essentially through a median position of the structure.

5. Apparatus according to claim 1 wherein said plurality of chain stoppers comprises a plurality of pairs of chain stoppers equal in number a plurality of pairs of anchor lines to be tensioned, means securing said chain stoppers at fastening points around said fixed floor, a circular rail secured to the fixed floor and essentially centered with respect to the geometric center of the chain stopper fastening points, and means mounting said pulleys on said circular rail for movement to different positions in alignment with different chain stoppers to enable tensioning different opposed pairs of anchor lines, using the same pulleys.

6. A method of tensioning anchor lines of a structure in the ocean comprising, connecting a first pair of anchor lines to anchors at opposite sides of the structure, directing each anchor line to a vertically displaceable pulling assembly connected to the structure by a pulley system including a pulling line, connecting the anchor lines to the pulling assembly, pulling on the pulling line from a vessel in the water to shorten the anchor lines, stopping each shortened anchor line with a stopper engaging the line, moving the pulling assembly toward the anchor line stoppers, removing slack from the anchor lines between the stoppers and the pulling assembly, and again pulling the pulling line from a vessel in the water to further shorten the anchor lines.

7. A method according to claim 6 wherein said step of directing each anchor line to a displaceable pulling assembly comprises, directing the lines respectively through a pair of pulleys connected to the structure between the pulling assembly and the stoppers.

8. A method according to claim 7 wherein said step of directing each line to a displaceable pulling assembly comprises, directing lines respectively through pulleys mounted for adjustment circumferentially of the structure.

9. A method according to claim 6 further comprising connecting to anchors, additional oppositely extending pairs of anchor lines extending at an angle to the first anchor lines, directing each additional line to the displaceable pulling assembly after shortening the first pair of lines, and shortening and tensioning the additional lines as mentioned above for the first pair of lines.

10. A method according to claim 9 wherein said step of stopping each anchor line in its shortened condition comprises providing one pair of such stoppers for each pair of anchor lines used for the structure and arranging said stopper devices in equi-angular relation with respect to the axis of the pulling assembly.

* * * * *